US008333623B2

(12) United States Patent
Nickel et al.

(10) Patent No.: US 8,333,623 B2
(45) Date of Patent: Dec. 18, 2012

(54) CABLE CONNECTOR RETENTION CLIPS

(75) Inventors: Joshua G. Nickel, San Jose, CA (US); Jonathan Haylock, Los Angeles, CA (US)

(73) Assignee: Apple Inc., Cupertino, CA (US)

( * ) Notice: Subject to any disclaimer, the term of this patent is extended or adjusted under 35 U.S.C. 154(b) by 114 days.

(21) Appl. No.: 12/942,931

(22) Filed: Nov. 9, 2010

(65) Prior Publication Data

US 2012/0115347 A1 May 10, 2012

(51) Int. Cl.
*H01R 4/48* (2006.01)

(52) U.S. Cl. ..... 439/859

(58) Field of Classification Search ..... 439/859.786, 439/729, 365–370, 100, 578, 865, 867, 94, 439/95, 92, 345
See application file for complete search history.

(56) References Cited

U.S. PATENT DOCUMENTS

| | | | | |
|---|---|---|---|---|
| 638,813 | A | 12/1899 | Ryan | |
| 2,492,917 | A | 12/1949 | Courtot | |
| 4,741,590 | A * | 5/1988 | Caron | 385/60 |
| 5,214,732 | A | 5/1993 | Beard et al. | |
| 5,269,701 | A | 12/1993 | Leibfried, Jr. | |
| D392,093 | S | 3/1998 | Dierking | |
| 5,788,528 | A | 8/1998 | Orr, Jr. et al. | |
| 6,257,920 | B1 | 7/2001 | Finona et al. | |
| 6,428,351 | B1 * | 8/2002 | Turner et al. | 439/540.1 |
| 6,447,022 | B1 * | 9/2002 | Allen | 285/305 |
| 6,908,339 | B2 * | 6/2005 | Tanaka | 439/607.01 |
| 7,101,215 | B2 | 9/2006 | Woellner et al. | |
| 7,201,598 | B2 * | 4/2007 | Griffin | 439/352 |
| 7,458,851 | B2 * | 12/2008 | Montena | 439/584 |
| D601,883 | S | 10/2009 | Catoggio | |
| 7,736,196 | B1 * | 6/2010 | Isaac et al. | 439/680 |
| 2009/0126167 | A1 | 5/2009 | O'Brien et al. | |

OTHER PUBLICATIONS

Mow et al., U.S. Appl. No. 12/577,128, filed Oct. 9, 2009.

* cited by examiner

*Primary Examiner* — Edwin A. Leon
*Assistant Examiner* — Harshad Patel
(74) *Attorney, Agent, or Firm* — Treyz Law Group; G. Victor Treyz; Jason Tsai

(57) ABSTRACT

Electrical devices may be tested using test equipment. A device may have an associated cable with a connector. The test equipment may have an associated cable with a connector. An adapter may have a pair of connectors. One of the adapter connectors may be connected to the connector of the cable associated with the device and the other of the adapter connectors may be connected to the connector of the cable that is associated with the tester. A retention clip may be attached to a groove in the adapter. Flexible members in the clip may each grasp an opposing side of the adapter within the groove. A retention member in the clip may bear against the connector on the cable that is associated with the device to hold the connectors for the device cable and the adapter together.

13 Claims, 8 Drawing Sheets

CABLE CONNECTOR RETENTION CLIPS

BACKGROUND

This relates to structures for holding cable connectors together, and more particular, to cable connector retention clips.

A variety of cables and connectors are used in modern electronic applications. For example, relatively large coaxial cables may be used to convey cable television signals. Smaller coaxial cables are often used in radio-frequency circuitry such as cellular telephones and computers. Miniature coaxial connectors can be provided at the ends of these small coaxial cables to allow the cables to be attached and detached from electronic equipment.

During testing, coaxial cable connectors may be used to connect a cable in a cellular telephone or other device that is being tested to a tester. In testing environments in which cables of different sizes are used, connectors may sometimes be used as adapters. For example, a connector with ports of different types can be used to form an interface between coaxial cables of different diameters.

It is generally desirable to securely attach cable connectors to each other. Accidental dislodgement of connectors and the cables to which the connectors are attached may interrupt testing and may damage sensitive equipment. Conventional miniature cable connectors are press fit together, so they may not always provide connections of sufficient stability.

It would therefore be desirable to be able to provide improved ways in which to secure cable connectors so that they cable connectors do not become accidentally disconnected during use.

SUMMARY

Electrical devices may be tested using test equipment. For example, an electronic device with radio-frequency circuitry may be tested using a radio-frequency tester. Cables may be used to convey radio-frequency signals from the device to the tester.

A radio-frequency cable that is associated with the device may have a radio-frequency connector. The test equipment that is used in testing the device may have an associated cable with a radio-frequency connector. An adapter may have a pair of radio-frequency connectors that are used in coupling the device cable and test equipment cable together.

One of the adapter connectors may be connected to the connector of the cable associated with the device and another of the adapter connectors may be connected to the connector of the cable that is associated with the tester. A retention clip may be attached to a groove in the adapter. Flexible members in the clip may each grasp an opposing side of the adapter. A retention member in the clip may bear against the connector on the cable that is associated with the device to hold the connectors for the device cable and the adapter together.

Further features of the invention, its nature and various advantages will be more apparent from the accompanying drawings and the following detailed description of the preferred embodiments.

DETAILED DESCRIPTION

Figure 1:
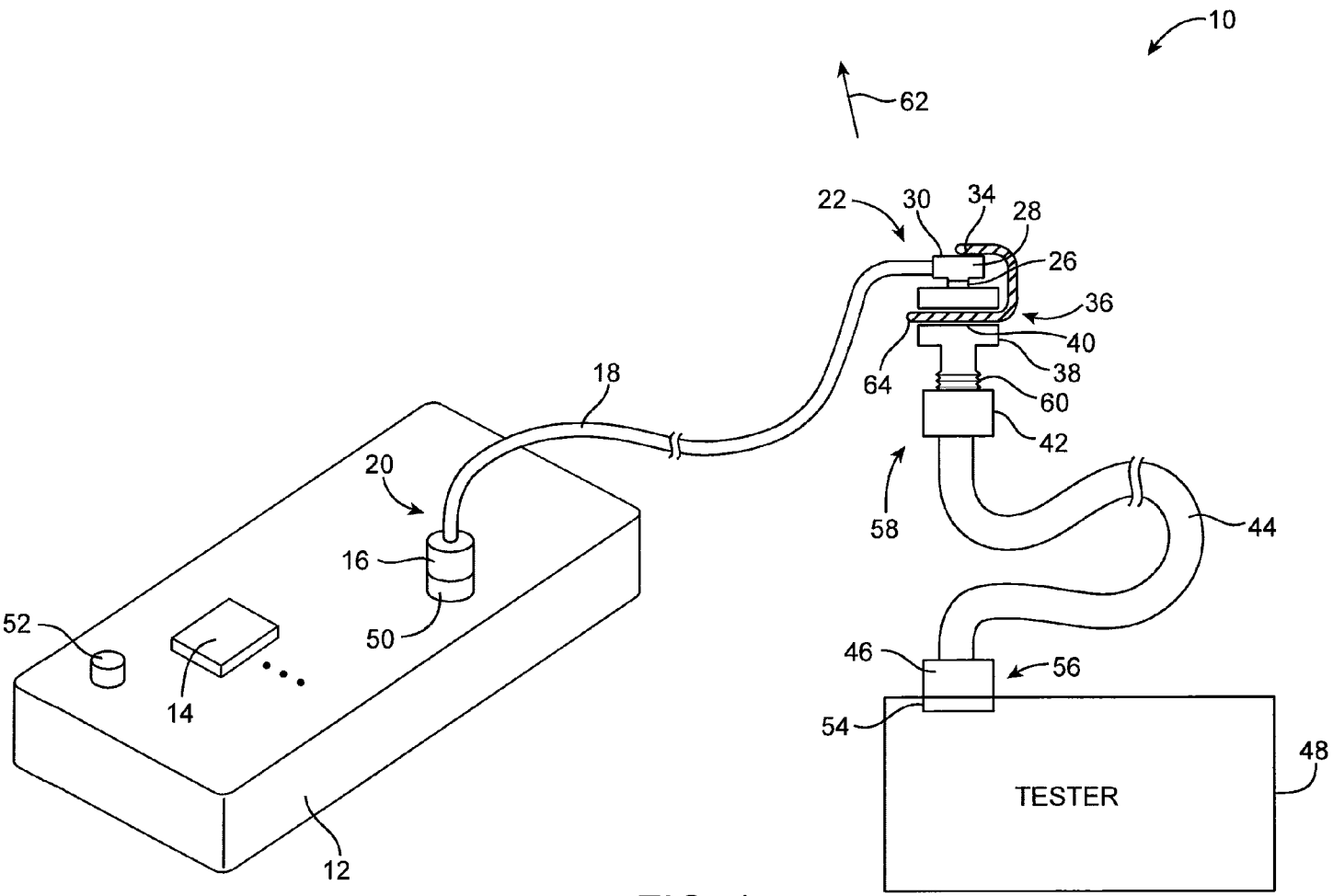
FIG. 1 is a diagram of an illustrative test system of the type that may contain cables with connectors in accordance with an embodiment of the present invention.

An illustrative system environment in which cables with connectors may be used is shown in FIG. 1. In the example of FIG. 1, system 10 is a test system in which test measurements are being made. If desired, cables with connectors may be used in other types of systems. The test system of FIG. 1 is merely illustrative.

As shown in FIG. 1, test system 10 may include a device under test such as device under test 12. Device under test 12 may include components such as components 14. Components 14 may include integrated circuits, discrete electrical components, switches, connectors, and other circuit components. Components 14 may, for example, be mounted to a printed circuit board. Device under test 12 may be a printed circuit board, a partly or fully assembled electronic device (e.g., part or all of a tablet computer, desktop computer, laptop computer, computing equipment integrated into a computer monitor, cellular telephone, media player, or other electronic equipment), or other electronic equipment.

Cables such as cables 18 and 44 may be used to couple device under test 12 to external equipment such as tester 48. During testing, circuitry such as circuitry in components 14 may generate signals that are evaluated by test equipment 48. For example, circuitry 14 may include radio-frequency transceiver circuitry that generates radio-frequency signals. It may be desirable to route the radio-frequency signals from circuitry 14 and device under test 12 to tester 48, so that these signals can be measured. The results of this type of test measurement may allow a designer to made design modifications (e.g., in a scenario in which device 12 is a prototype) or may allow a technician to decide whether device 12 is performing sufficiently well to be shipped to end users (e.g., when device 12 is being evaluated at a test station in a manufacturing line).

In theory, a single cable could be used to connect device 12 to tester 48. In practice, multiple cables are often used. In the example shown in FIG. 1, device under test 12 is coupled to tester 48 using a path that includes first cable 18 (e.g., a thin cable that is suitable for use in the interior housing of a cellular telephone or other device) and second cable 44 (e.g., a thicker cable that is suitable for attaching to tester 48 and being handled repeatedly by test personnel).

Cable 18 may be, for example, a cable with a diameter of less than 2 mm (e.g., 0.81 mm, 1.13 mm, 1.32 mm, 1.37 mm, etc.) and cable 44 may be, for example, a cable with a diameter of about 2-5 mm (as an example).

Cables 18 and 44 may have different terminating connectors. These connectors may be coupled to each other using an adapter such as adapter 38.

In the example shown in FIG. 1, cable 18 has a first end (end 20) having connector 16 and a second end (end 22) having connector 30. Cable 44 may have a first end (end 56) having connector 46 and a second end (end 58) with a second connector (connector 42). Connector 16 of cable 18 may be a U.FL or W.FL connector (as an example) that is mated to a corresponding connector 50 in device 12. Connectors of this type are compact and may not have room for threads and nuts (i.e., these connectors may be free of threads so that connections are formed by press fitting the connectors together). Connector 30 of cable 18 may likewise be a compact connector such as a U.FL or W.FL connector. As an example, connector 30 may be adapted to connect to connector 52 in device 12 during normal operation. During testing, connector 30 may be disconnected from connector 52 and attached to port 26 of adapter 38.

Port 26 of adapter 38 may be, for example, a Hirose U.FL (commonly referred to as U.FL) or Hirose W.FL (commonly referred to as W.FL) connector port that receives connector 30 (e.g., to form a press-fit connection). The other port of adapter 38 may be associated with a different type of connector. For example, the other port of adapter 38 may be a larger connector such as a SubMiniature version A (SMA) connector (i.e., adapter 38 may be an SMA-to-U.FL or SMA-to-W.FL adapter). The SMA connector port of adapter 38 may have threads 60 that screw into mating threads in connector 42 on cable 44. Connector 42 may be, for example, an SMA connector. Connector 46 at end 56 of cable 44 may also be an SMA connector (as an example) and may mate with connector 54 in tester 48 (i.e., connector 54 may be an SMA connector).

In a configuration of this type, the relatively large diameter of cable 44 and the relatively larger sizes of connectors 42 and 46 help test personnel at tester 48 connect and disconnect cable 44 from equipment 48 and/or adapter 38. SMA connectors have threads, so these connectors can be attached and detached from each other repeatedly as needed (e.g., by screwing and unscrewing threaded nuts in the SMA connectors).

The U.FL or W.FL connection schemes used in system 10 tend to be more delicate than SMA connectors (due to the miniature size and lack of threads in U.FL and W.FL connectors). Because these connections are small, they can be incorporated into compact enclosures. For example, connectors such as connectors 50 and 52 in device 12 may be surface-mounted components that are soldered to a printed circuit board in device 12.

Adapter 38 forms a transition between connector 42 at end 58 of cable 44 and connector 30 at end 22 of cable 18. The port of adapter 38 that has threads 60 and that is screwed into threaded connector 42 of cable 44 tends to form a connection that is more robust than the port of adapter 38 that is formed by connector 26.

If care is not taken, cable 18 can become dislodged from adapter 38 as the components of system 10 are handled during testing. In particular, even relatively slight movements of cable end 22 in direction 62 (in the orientation of FIG. 1) may cause cable connector 30 to separate from adapter port 26. This can disrupt operation of test system 10 and may cause damage to the connectors or circuitry of system 10.

To avoid undesirable disconnection between connector 30 and adapter port 26 of adapter 38 (or other connector that receives connector 30), a connector retention structure may be used. The connector retention structure may help hold connector 30 to the connector in port 26 of adapter 38 (or other such connector) during handling.

In the example of FIG. 1, connector retention structure 36 has been formed in the shape of a clip. The clip may be formed from a piece of flexible metal (e.g., spring metal), plastic, or other suitable materials. Connector retention portion 34 of clip 36 can be implemented using a flexible member that bears against the outermost surface of connector 30 to hold connector 30 in place against connector 26. Flexible portion 64 of clip 36 may form engagement structures that mate with engagement structures on adapter 38. Adapter 38 may, for example, have a groove such as groove 40 or other feature (e.g., a ridge, shoulder, tooling hole, protruding pin, etc.) that serves as an engagement structure. Portion 64 may have the shape of curved flexible member such as prongs that grasp adapter 38 within groove 40. The grooved shape of groove 40 (or other such engagement structure) may help prevent portion 64 of clip 36 from slipping off of adapter 38 along its length. The curved shape of the prongs in portion 64 may be selected to surround and grasp the cylindrical surface of adapter 38 in groove 40, so that clip 36 does not pull away from adapter 38 radially.

Figure 2:
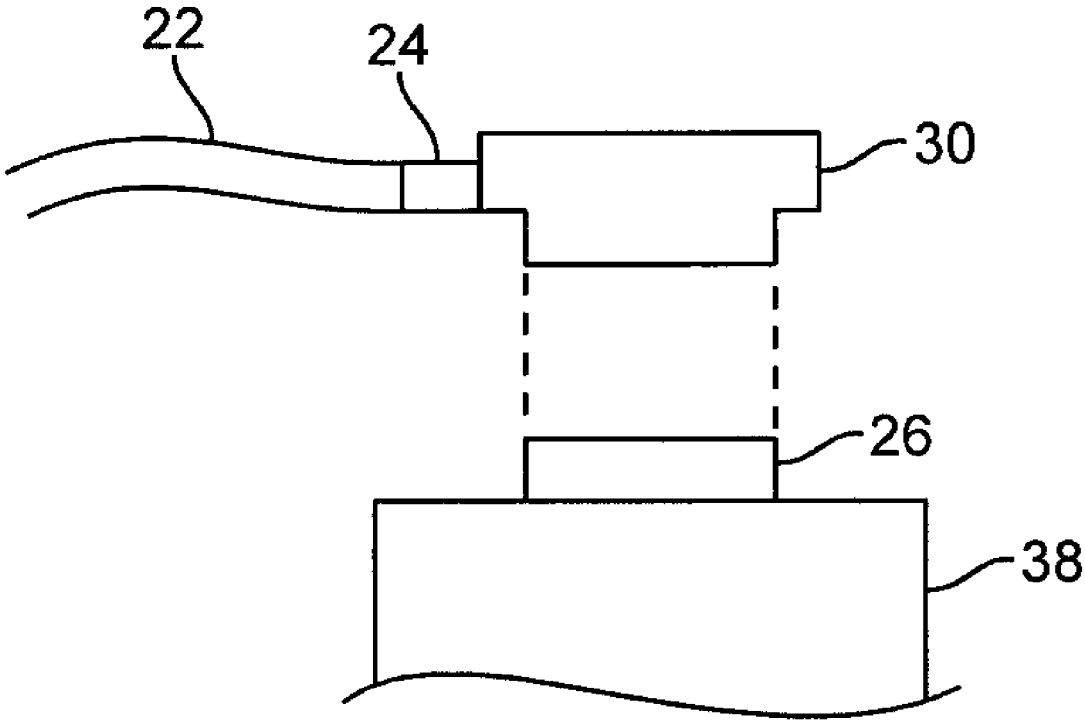
FIG. 2 is a cross-sectional side view of a cable connector and associated connector on an adapter in accordance with an embodiment of the present invention.

FIG. 2 is a side view of a portion of adapter 38 and cable 22. As shown in FIG. 2, cable 22 may be received within portion 24 of connector 30 (i.e., connector 30 may be pigtailed to cable 18). Connector 30 may mate with corresponding connector 26 on adapter 38 (sometimes referred to as dual-port connector 38 or connector 38). In the exploded view of FIG. 2, connectors 30 and 26 are disconnected. In the view of FIG. 1, connectors 30 and 26 have been connected to each other to allow measurements on device 12 and its circuitry 14 to be made using tester 48.

Figure 3:
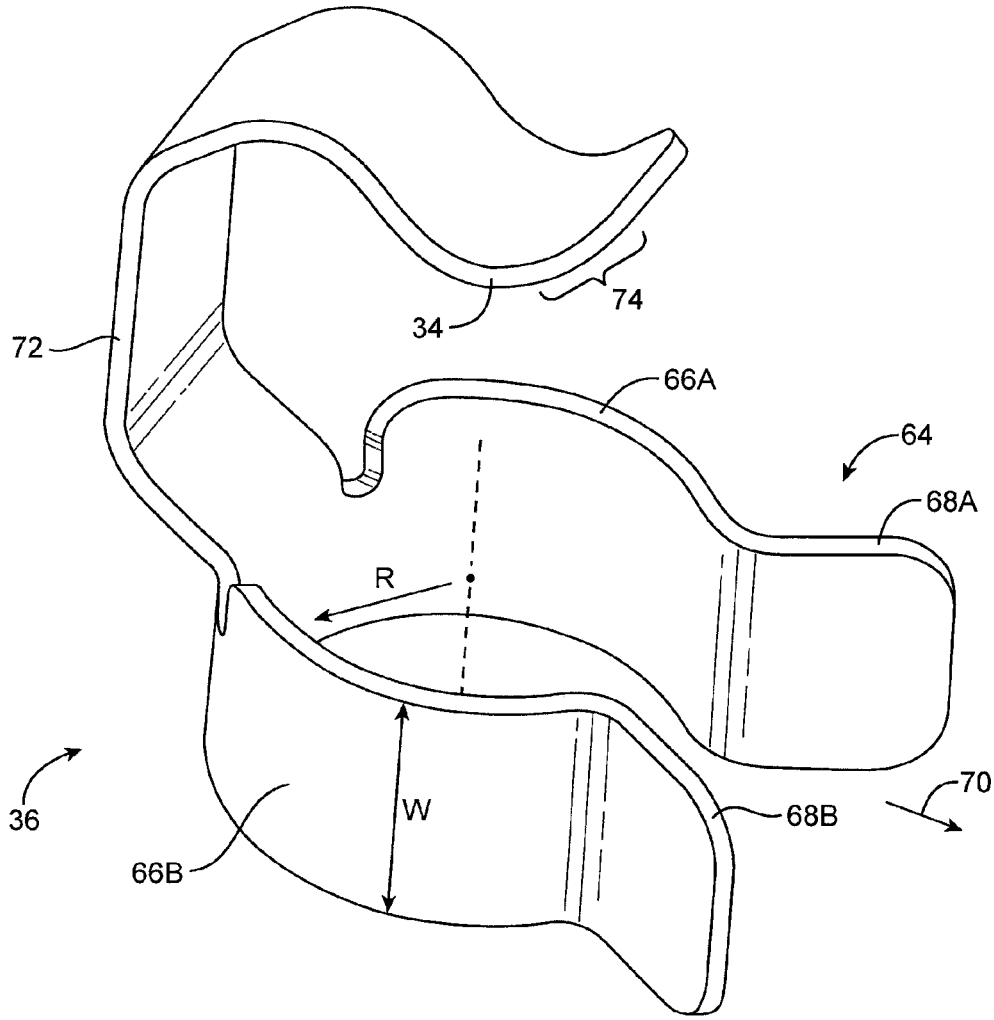
FIG. 3 is a perspective view of an illustrative clip that may be used in holding cable connectors together in accordance with an embodiment of the present invention.

A perspective view of an illustrative clip that may be used in holding cable connectors such as connectors 30 and 26 together is shown in FIG. 3. As shown in FIG. 3, clip 36 may have a pair of flexible members such as prongs 64 having curved portions 66A and 66B. Curved portions 66A and 66B may have a width W that is less than the width of groove 40 of adapter 38 (FIG. 1). This allows clip 36 to fit into groove 40 when attached to adapter 38. To promote formation of a satisfactory attachment between clip 36 and adapter 38, the radius of curvature of curved portions 66A and 66B (illustrated by radius R of FIG. 3) may be selected to match the radius of curvature of adapter 38 in groove 40. Tip portions 64A and 64B of prongs 64 may be flared outwards to facilitate expansion of prongs 64 away from each other and subsequent attachment of clip 36 to adapter 38 when clip 36 is moved towards adapter 38 in direction 70. Vertical member 72 of clip 36 may be used to attach retention member 34 of clip 36 to prongs 64. Flared region 74 of flexible member 34 may help portion 34 ride up and over connector 30 when clip 36 is pressed onto adapter 38.

Figure 4:
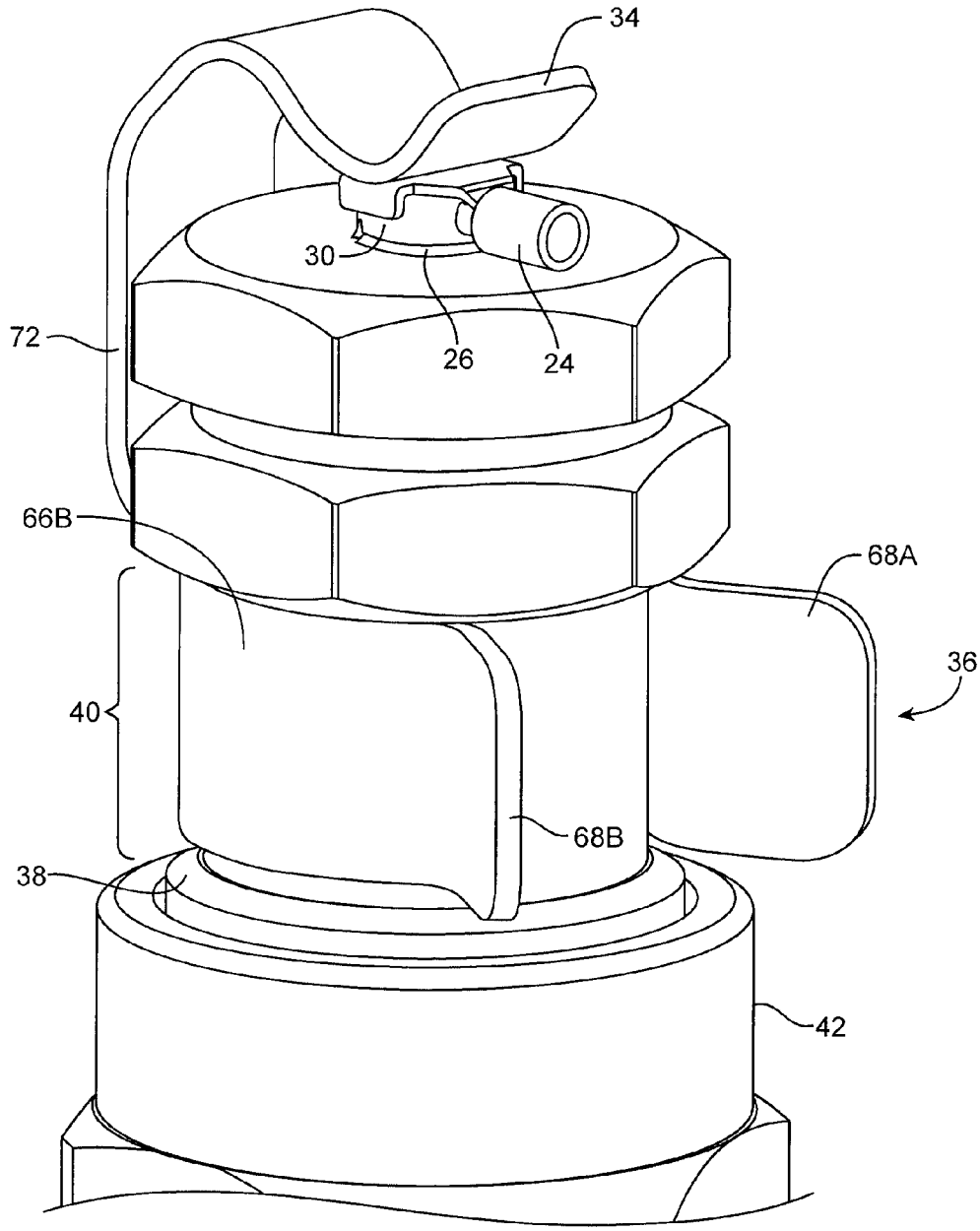
FIG. 4 is a perspective view of the illustrative clip of FIG. 3 being used to hold cable connectors together in accordance with an embodiment of the present invention.

FIG. 4 is a perspective view of the illustrative clip of FIG. 3 being used to hold cable connector 30 and 26 together (i.e., to press connector 30 inwardly against connector 26 of adapter 38).

Figure 5:
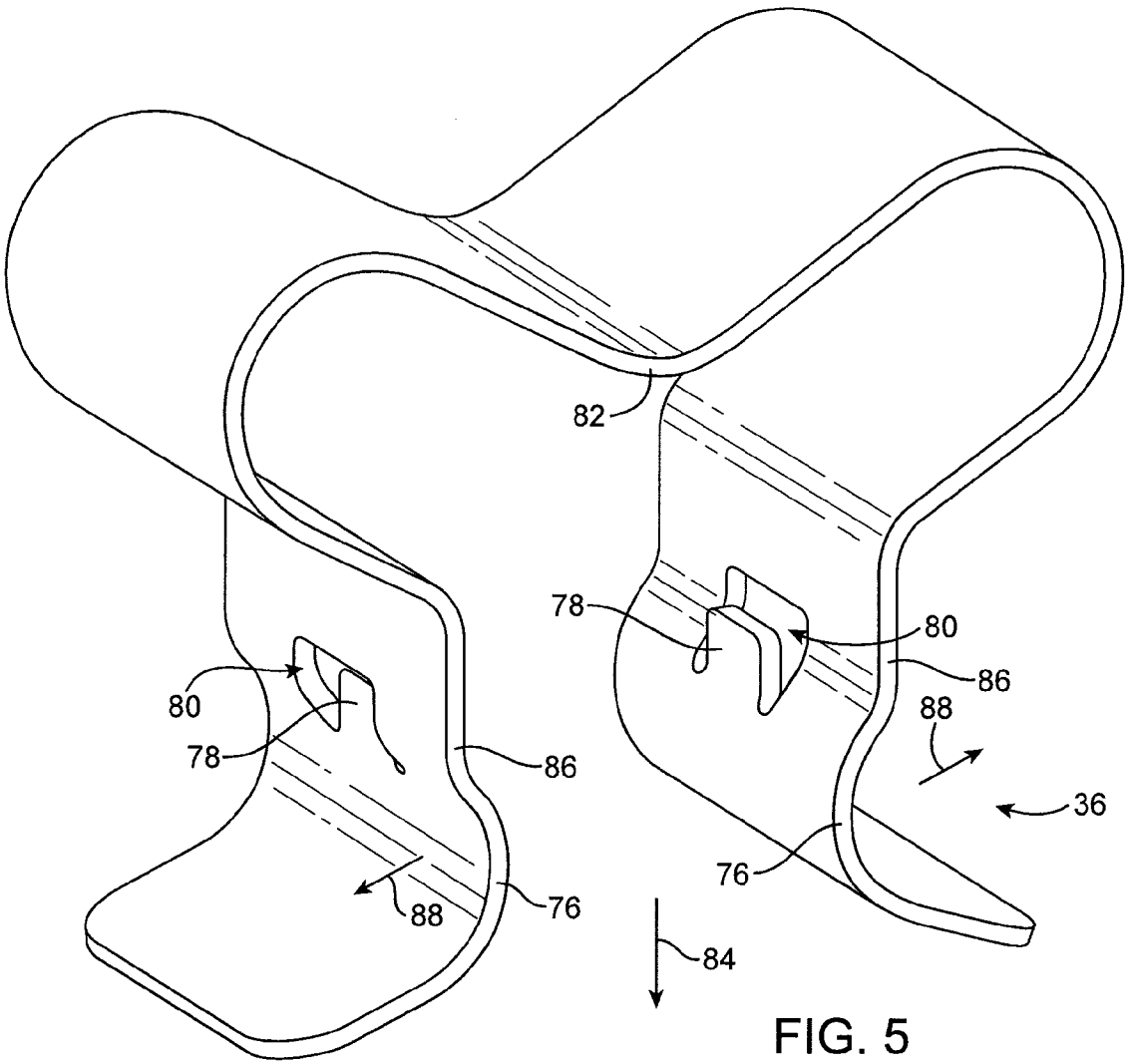
FIG. 5 is a perspective view of another illustrative clip that may be used in holding cable connectors together in accordance with an embodiment of the present invention.

If desired, other connector retention structure configurations may be used. FIG. 5 is a perspective view of an illustrative arrangement that may be used for clip 36 in which clip 36 is formed from a strip of metal in a W-shape and is adapted to be attached to adapter 38 by movement in downwards direction 84. When pressed downwards against adapter 38 in direction 84, flared tip portions 76 of flexible prongs 86 will cause prongs 86 to bend away from each other in directions 88 (i.e., in radially outward directions away from the longitudinal axis of adapter 38). Once clip 36 has been pressed into place on adapter 38, prongs 78 (which may be formed form pieces of clip 36 that are bent inwardly from holes 80) may fit into groove 40 and may help retain clip 36 on adapter 38. Portion 82 may form a connector retention structure that bears against the upper portion of connector 30 to hold connector 30 in place on adapter 38.

Figure 6:
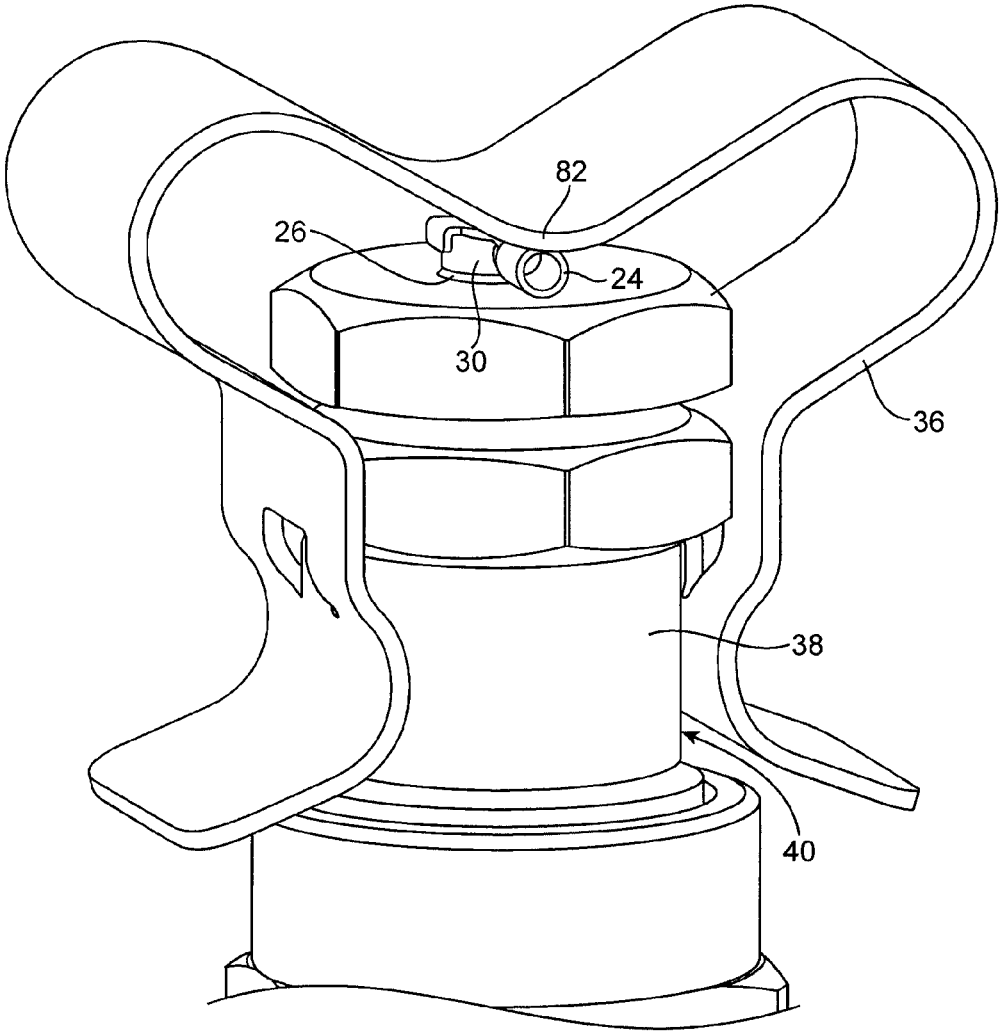
FIG. 6 is a perspective view of the illustrative clip of FIG. 5 being used to hold cable connectors together in accordance with an embodiment of the present invention.

FIG. 6 is a perspective view of clip 36 of FIG. 5 after attachment to adapter 38 to hold connector 30 in place against connector port 26 of adapter 38.

If desired, clip 36 may be formed from a combination of parts and/or materials (e.g., one or more metal members, one or more plastic members, one or more fiber-composite member, etc.). Connectors 30 and 16 need not be U.FL or W.FL connectors. Larger or smaller radio-frequency connectors or other suitable connectors may be used on cable 18 if desired (e.g., other connectors that are free of threads). Connectors 42 and 46 may be SMA connectors or may be larger or smaller radio-frequency connectors or other connectors on cable 18 (e.g., larger or smaller connectors with threads).

In the example of FIG. 1, adapter 38 has a first port with a connector (connector 26) that is adapted to mate with connector 30 and a second port with a connector (the connector associated with threads 60) that is adapted to mate with connector 42. If desired, clip 36 may be used to hold connector 30 to a connector such as connector 26 that is pigtailed on the end of a cable such as cable 44 rather than being formed as part of an adapter. Connectors 50, 52, 26, 60 and 54 may be male connectors (as an example) and connectors 16, 30, 42, and 46 may be female connectors (as an example). During testing, tester 48 may be coupled to circuitry such as circuitry 14 on device under test 12 or may be coupled to other circuitry in system 10 (e.g., another tester, a cable, an accessory, or other component that has a connector). System 10 may be used to perform tests or may be used to convey radio-frequency signals in connection with other suitable applications.

If desired, clip 36 may be attached to adapter 38 using welds, adhesive, screws or other fasteners, or other such attachment structures. Clip 36 may also, if desired, be formed as an integral portion of adapter 38 (e.g., by casting or machining clip 36 and adapter 38 from a unitary piece of material such as plastic, metal, etc.).

Figure 7:
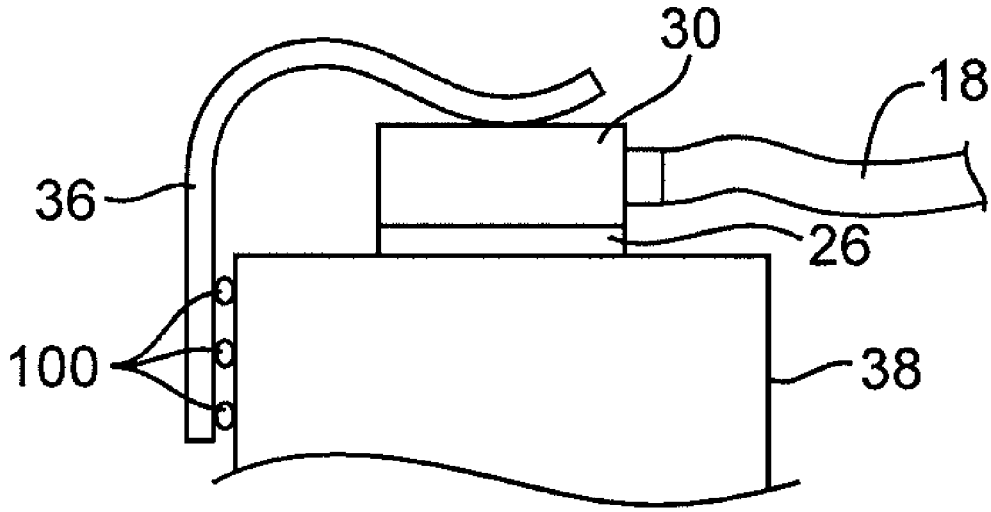
FIG. 7 is a side view of an illustrative clip that has been attached to an adapter in accordance with an embodiment of the present invention.

An illustrative configuration for clip 36 in which clip 36 is attached to adapter 38 is shown in FIG. 7. As shown in FIG. 7, clip 36 (e.g., a vertical portion of clip 36 or other suitable portion of clip 36) may be attached to adapter 36 using attachment mechanisms 100 (e.g., welds, solder, adhesive, screws, rivets, or other fasteners, etc.). In the FIG. 7 example, clip 36 has been attached to a side portion of adapter 38. This is merely illustrative. Clip 36 may be attached to adapter 38 (or other cable connector) along the top surface of adapter 38, along a side surface, along other portions of adapter 38, using more than one part of adapter 38, etc.

Figure 8:
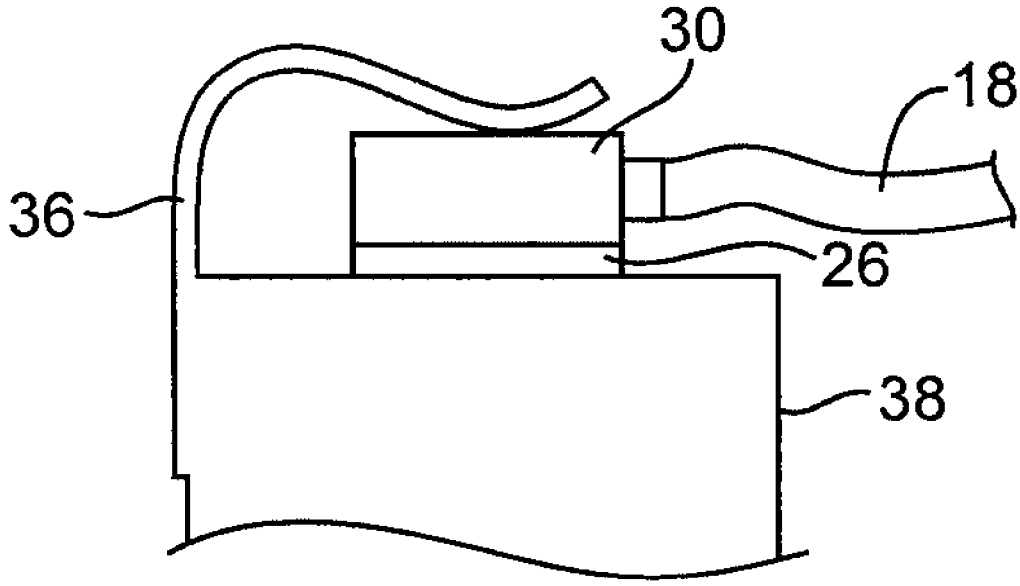
FIG. 8 is a side view of an illustrative clip that has been formed as an integral portion of an adapter in accordance with an embodiment of the present invention.

FIG. 8 is a side view of an illustrative configuration for clip 36 in which clip 36 has been formed as an integral portion of adapter 38 (or other cable connector). Clip 36 and adapter 38 may, for example, be metal or plastic structures that are formed as a unitary part by casting these structures in the same mold (e.g., a metal mold, a plastic injection mold, etc.).

The foregoing is merely illustrative of the principles of this invention and various modifications can be made by those skilled in the art without departing from the scope and spirit of the invention.

What is claimed is:

1. A cable connector retention structure adapted to help hold a first cable connector and a second cable connector together, comprising:

flexible portions that are operable to grasp the second cable connector; and a retention member that is operable to bear against the first cable connector to hold the first cable connector to the second cable connector, wherein the retention member bears against the first cable connector in a first direction, and wherein the flexible portions bear against the second cable connector in a second direction that is perpendicular to the first direction.

2. The cable connector retention structure defined in claim 1, wherein the cable connector retention structure further comprises flared portions in the flexible portions.

3. The cable connector retention structure defined in claim 1, wherein the flexible portions and the retention member comprise a material selected from the group consisting of plastic and metal.

4. The cable connector retention Structure defined in claim 1, wherein the flexible portions and the retention member comprise integral metal portions of a metal clip and wherein the flexible portions and the retention member have flared tips.

5. The cable connector retention structure defined in claim 1, wherein the flexible portions comprise a pair of curved members.

6. The cable connector retention structure defined in claim 1, wherein the flexible portions comprise a pair of flexible members with flared tips that are adapted to flex the flexible members away from each other when the cable connector retention structures are pressed onto the second cable connector along a longitudinal axis of the second cable connector.

7. A cable connector retention clip adapted to hold a first connector to a second connector, wherein the first and second connector are free of threads and wherein the second connector has a portion with a groove, comprising:

first and second flexible members that are operable to grasp opposing sides of the groove; and a connector retention structure that is connected to the first and second flexible members and that is operable to bear against the first connector to hold the first connector and second connector together.

8. The cable connector retention clip defined in claim 7, wherein the first and second flexible members comprise flared tips.

9. The cable connector retention clip defined in claim 8 wherein the connector retention structure has a flared portion.

10. A method of maintaining a first cable in connection with a second cable using an adapter and a retention clip, wherein the first cable has a first radio-frequency connector, wherein the adapter has a second radio-frequency connector that is connected to the first radio-frequency connector and has a third radio-frequency connector, and wherein the second cable has a fourth radio-frequency connector that is connected to the third radio-frequency connector, the method comprising:

grasping the adapter with a flexible portion of the clip; and bearing against the first radio-frequency connector with a connector retention portion of the clip to hold the first radio-frequency connector and the second radio-frequency connector together.

11. The method defined in claim 10, wherein the flexible portion comprises a pair of opposing flexible members.

12. The method defined in claim 11, wherein the connector retention portion of the clip has a flared portion, the method further comprising:

attaching the retention clip to the adapter by pressing the clip towards the adapter to cause the flared portion to ride up and over the first connector.

13. A cable connector retention structure adapted to help hold a first cable connector and a second cable connector together, comprising:

a retention member that is operable to bear against the first cable connector to hold the first cable connector to the second cable connector; and attachment mechanisms that attach the retention member to the second cable connector, wherein the attachment mechanisms are selected from the group consisting of: welds, solder, adhesive, screws, and rivets.

* * * * *